US006733260B2

(12) United States Patent
Skoglund et al.

(10) Patent No.: US 6,733,260 B2
(45) Date of Patent: May 11, 2004

(54) POWDER FILLING METHOD AND ARRANGEMENT THEREFOR

(75) Inventors: Paul Skoglund, Höganäs (SE); Sven Allroth, Höganäs (SE); Hilmar Vidarsson, Höganäs (SE)

(73) Assignee: Höganäs AB, Höganäs (SE)

( * ) Notice: Subject to any disclaimer, the term of this patent is extended or adjusted under 35 U.S.C. 154(b) by 9 days.

(21) Appl. No.: 10/181,893

(22) PCT Filed: Jan. 31, 2001

(86) PCT No.: PCT/SE01/00173

§ 371 (c)(1),
(2), (4) Date: Oct. 8, 2002

(87) PCT Pub. No.: WO01/56726

PCT Pub. Date: Aug. 9, 2001

(65) Prior Publication Data

US 2003/0113222 A1 Jun. 19, 2003

(30) Foreign Application Priority Data

Feb. 2, 2000 (SE) ..... 0000171

(51) Int. Cl.[7] ..... B22F 3/12
(52) U.S. Cl. ..... 425/78
(58) Field of Search ..... 425/78

(56) References Cited

U.S. PATENT DOCUMENTS

| | | | | |
|---|---|---|---|---|
| 4,109,027 A | | 8/1978 | Crose | |
| 4,473,526 A | | 9/1984 | Buhler et al. | |
| 5,397,530 A | * | 3/1995 | Narasimhan et al. | 419/1 |
| 5,514,327 A | * | 5/1996 | Schneider | 419/36 |
| 5,881,357 A | | 3/1999 | Takemoto et al. | |
| 5,897,826 A | | 4/1999 | Lashmore et al. | |

FOREIGN PATENT DOCUMENTS

| | | |
|---|---|---|
| DE | 1 016 538 | 9/1957 |
| DE | 28 08 255 | 10/1978 |

* cited by examiner

*Primary Examiner*—Daniel Jenkins
(74) *Attorney, Agent, or Firm*—Burns, Doane, Swecker & Mathis, L.L.P.

(57) ABSTRACT

A powder box, an arrangement for a powder box comprising an insert and a method for filling powder into a cavity formed in a die. Gas is supplied to a powder box, which is movable toward and away from a position just above the cavity. The gas is supplied through a permeable plate, which is arranged on at least one insert and which faces the interior of the powder box, so that particles of the powder in the powder box are movable relative to each other. The fluidisation of the powder shortens the filling time and results in an even particle size distribution in the cavity.

18 Claims, 4 Drawing Sheets

Fillability index for fluidised powder box

| | | Test 1 | speed 5 | Test 2 | speed 10 | Test 3 | speed 15 | Test 4 | speed 20 | Test 5 | speed 25 | Test 6 | speed 30 |
|---|---|---|---|---|---|---|---|---|---|---|---|---|---|
| Cavity no | Volume (cm3) | Fill weight (g) | Fill density (g/cm3) | Fill weight (g) | Fill density (g/cm3) | Fill weight (g) | Fill density (g/cm3) | Fill weight (g) | Fill density (g/cm3) | Fill weight (g) | Fill density (g/cm3) | Fill weight (g) | Fill density (g/cm3) |
| 1 | 11,708 | 102,31 | 3,43 | 100,35 | 3,36 | 100,34 | 3,36 | 98,61 | 3,32 | 98,38 | 3,30 | 98,8 | 3,32 |
| 2 | 7,222 | 126,60 | 3,36 | 124,26 | 3,31 | 124,35 | 3,32 | 122,13 | 3,26 | 121,75 | 3,24 | 122,32 | 3,26 |
| 3 | 4,502 | 141,58 | 3,33 | 139,05 | 3,29 | 139,26 | 3,31 | 136,76 | 3,25 | 136,26 | 3,22 | 136,9 | 3,24 |
| 4 | 2,702 | 150,26 | 3,21 | 147,60 | 3,16 | 147,85 | 3,18 | 145,31 | 3,16 | 144,74 | 3,14 | 145,42 | 3,15 |
| 5 | 1,798 | 155,93 | 3,15 | 153,16 | 3,09 | 153,46 | 3,12 | 150,89 | 3,10 | 150,29 | 3,09 | 150,96 | 3,08 |
| Fillability index | | | 8,06% | | 7,97% | | 7,14% | | 6,52% | | 6,46% | | 7,19% |

Fillability index % = ((cavity no1 - cavity no5) / cavity no1)x100

*Fig. 3*

POWDER FILLING METHOD AND ARRANGEMENT THEREFOR

FIELD OF THE INVENTION

The present invention relates to a powder filling method and an arrangement therefor. Specifically the invention concerns a powder box arrangement for filling powder into a cavity formed in a die.

BACKGROUND OF THE INVENTION

In conventional powder filling methods, powder in a powder box or filling shoe is transferred into a cavity formed in a die when the powder box is brought to a position just above the cavity. However, when entrapped air in the cavity is driven away by the powder, light particles whirl up while heavy particles drop quickly so that unevenness in particle size distribution occurs in the cavity. As a result, there is a risk that a sintered powder metallurgical component made from the powder will get a non-uniform density distribution and, as a consequence, less accurate dimensions as well as non-uniformal mechanical strength and magnetic properties.

A method eliminating some of the problems with conventional filling is disclosed in U.S. Pat. No. 5,881,357. This patent discloses a powder box having at least one pipe disposed within the powder box. Each pipe which is fastened in the wall of the powder box has a plurality of holes for supplying gas into the powder in the powder box.

OBJECTS OF THE INVENTION

An object of the present invention is to provide a powder box arrangement which eliminates the use of pipes and problems originating from the use thereof.

A second object is to provide an arrangement that can easily be adapted to suit any powder box.

A third object of the invention is to provide a powder box and a method for filling powder in a cavity uniformly and in a short time period.

A forth object of the invention is to provide a powder box and a filling method that secures good flowability of the powder in a vertical direction.

These objects as well as other objects that will be apparent from the description below, have now been obtained according to the present invention by providing a powder box according to claim 1, an arrangement for a powder box comprising an insert according to claim 4 and a method for filling powder into a cavity according to claim 8.

SUMMARY OF THE INVENTION

In brief the arrangement according to the invention concerns a powder box having arranged therein at least one insert comprising a permeable plate, a gas impermeable backing and a spacing therebetween. The spacing is connectable to a gas supply through at least one hose.

The invention also comprises a method for filling powder into a cavity formed in a die comprising the steps of:

a) supplying gas to a powder box, which is movable horizontally toward and away from a position just above the cavity, whereby the gas is supplied through a permeable plate which is arranged on at least one insert and which faces the interior of the powder box so that particles of the powder in the powder box are movable relative to each other; and b) moving the powder box to the position just above the cavity so that the powder in the powder box enters the cavity at least by gravity.

Finally the invention also concerns the insert as defined above.

DETAILED DESCRIPTION OF THE INVENTION

The key features of the present invention is the insert and the arrangement thereof in the powder box.

The configuration of the insert is decided by the man skilled in the art in view of the configuration of the die cavity and the powder box. Normally the insert is an essentially plane surface although other shapes may be used.

The permeable plate preferably consists of a porous material such as a polymer, metallic, or a ceramic material or a mixture thereof. The largest pore of the permeable plate should be smaller than the smallest particle of the powder to prevent the powder from clogging the pores.

Suitable materials for the backing are metals and polymers such as polyamides.

The inserts which may be prepared with an optional relation between height and length, are arranged to partially or totally cover a side wall of the powder box. The insert(s) may also be arranged so as to incline towards the bottom of the powder box or may be arranged on a cover covering the powder box. One insert is sufficient for simple cavity geoemtries.

A preferred embodiment of the powder box according to the invention comprises two inserts arranged on opposing sides of the powder box so that they are positioned on two opposing sides of the cavity when the powder box is positioned just above the cavity in the die.

The powder box is preferably covered with a cover to avoid spillage, contamination and to minimise dusting. The cover is preferably fitted with an exhaust hole to prevent the build up of the fluidising media, such as air or gas.

It can easily be realised that the insert according to the invention can be adapted to suit any powder box and any cavity configuration.

The powder filling arrangement according to the present invention improves the filling capacity by releasing air that becomes entrapped during the filling of the powder into the cavity.

Furthermore, and in contrast to the arrangement disclosed in the U.S. Pat. No. 5,881,357 which also concerns fluidised filling, the filling arrangement according to the present invention improves the filling capacity by reducing the friction of the powder particles against the walls of the powder box during the filling by using the inserts. Another advantage in comparison with the arrangement known from this U.S. patent is that the inserts are arranged in the powder box in such a way that they do not obstruct the flow of the powder during the filling of the powder into the cavity as is the case with the pipes in the known apparatus. This is especially important as every obstruction for the powder flow on the way to the cavity may cause a segregation of the powder. Unexpectedly it has also been found that approximately the same filling density can be obtained for cavities having quite different sizes and that the fill density is independent of the speed of the powder box. The arrangement for improving the filling capacity according to the present invention can also easily be adapted to a wide variety of existing powder boxes with simple fastening means, such as glue, screws, welding etc. Furthermore, the fill volume of a powder box having a given volume may be varied by adjusting the angle of inclination $\alpha$ which should be >0° C. as is described below.

BRIEF DESCRIPTION OF THE DRAWINGS

The invention will now be further described below with reference to the appended drawing showing a presently preferred embodiment.

FIG. 3 is a table with results from a test using the powder box according to the invention.

DETAILED DESCRIPTION OF THE DRAWINGS

Figure 1:
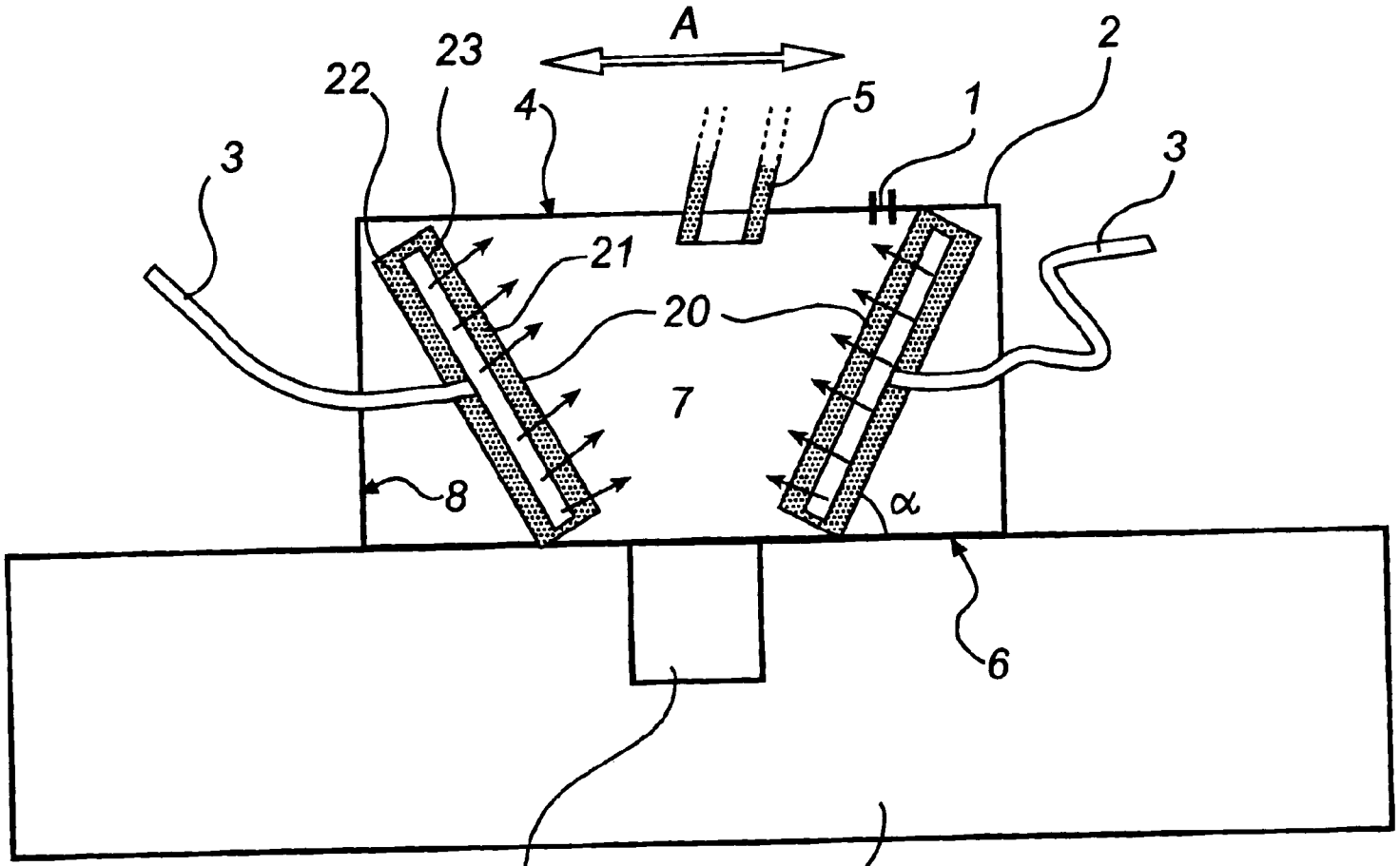
FIG. 1 is a schematic drawing showing a movable fluidised powder box with two inserts.

A powder box 2 for filling powder into a cavity 30 formed in a die 31 according to the present invention is shown in FIG. 1. The powder box 2 is connected to a flexible hose 3 for supply of gas to the interior of the powder box 2.

The powder box 2 is covered by a cover 4. The cover 4 is penetrated by a pipe 5 which supply powder into the powder box 2. The cover 4 has an exhaust hole 1 for gas to prevent a pressure build up in the powder box 2. The bottom 6 of the powder box 2 is open.

The powder box 2 has two inserts 20 arranged therein. The inserts 20 are attached to opposing sides of the walls 8 on the inside of the powder box 2 by means of glue, screws, welding or the like.

The angle $\alpha$ of the inserts relative the bottom 6 of the powder box 2 is normally between 30° and 90°. The length of the inserts 20 is decided by the size of the cavity 30 to be filled.

The inserts 20 include a permeable plate 21 facing the interior of the powder box 2, a gas impermeable backing or holder 22, and a spacing 23 therebetween.

Figure 2A:
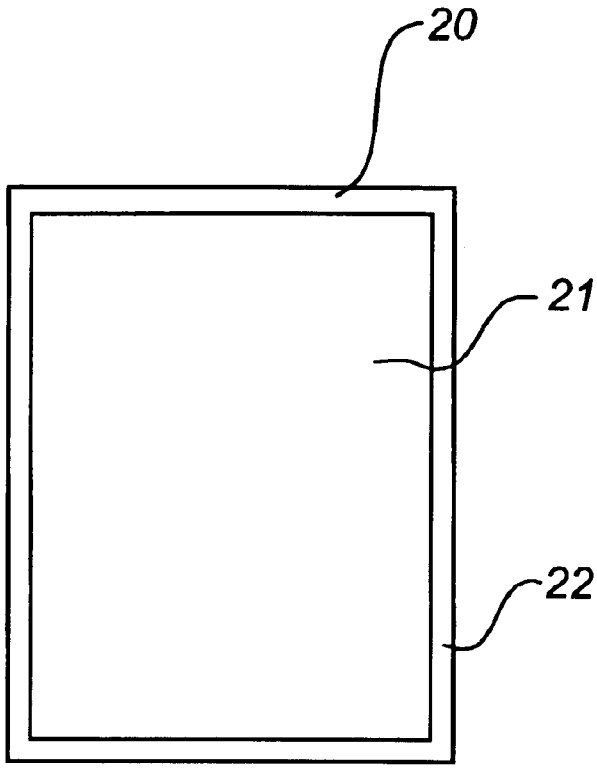
FIG. 2 is a schematic drawing showing a) a front view and b) a side view of an insert.
Figure 2B:
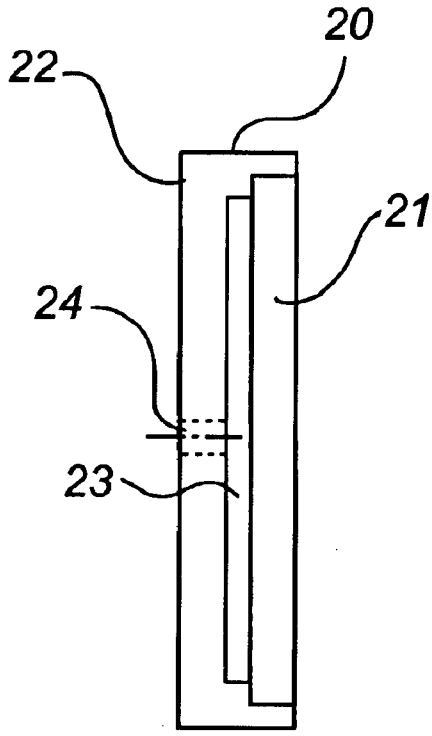

A detail view of the inserts are shown in FIG. 2. The porous plate 21, made of PPMD available from PIAB Sweden, is glued to the holder 22 made of polyamide. A threaded hole 24 is located in the centre of the holder 22 for connecting the spacing 23 to a gas source with a flexible hose 3. The hose 3 may also be glued or by other means fastened to the hole 24 in the holder 22. The hose 3 penetrates the wall 8 of the powder box 2.

Referring again to FIG. 1 the powder box 2 is movable in a horizontal direction A toward and away from a position just above the cavity 30 in the die 31. Powder (having room temperature or higher) is supplied intermittently through the pipe 5. Gas or air (having room temperature or higher) is supplied to the powder box 2 when the box approaches the cavity 30. The gas is supplied from the gas source through the hose 3 and into the spacing 23 from where the gas escapes into the powder through the permeable plate 21. The gas flow is set to such a value that fluidisation of the powder particles in the powder bed 7 is initiated. The fluidisation makes the particles move relative to each other to an extent that causes visual bubbling of the powder.

The powder enters the cavity 30 when the powder box 2 is located above the cavity 30. Due to the fluidisation of the powder, the powder enters the cavity 30 easily and smoothly without whirling up in the powder bed 7, so that unevenness in particle size distribution in the cavity 30 is unlikely to occur.

The above method can be used for gravity, sequence as well as suction filling.

FIG. 3 shows a table with results from a test run where decreasing sized cavities (cavity no 1–5) were filled with Distaloy AE® (an iron powder from Hoganas AB) with an increasing speed (test 1-test 6). The results show that, within the studied region, the fill density is independent of the cavity volume.

Figure 4:
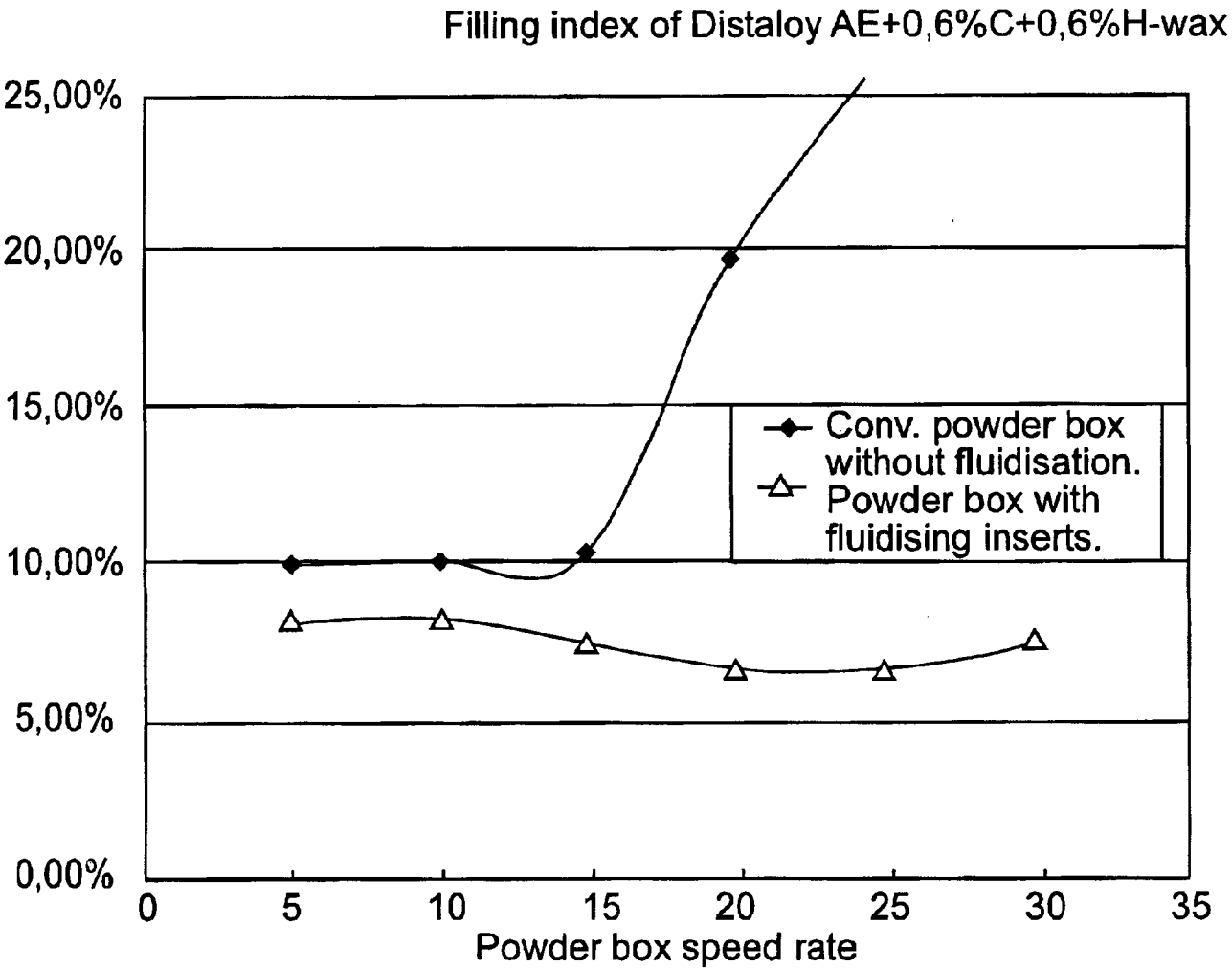
FIG. 4 is a chart comparing a conventional powder box without fluidisation with a powder box with fluidising inserts according to the invention.

FIG. 4 shows that the fillability index for the powder box with fluidising inserts according to the invention does not change with the speed rate of the powder box as is the case for conventional powder boxes without fluidisation.

What is claimed is:

1. A powder box (2) for filling powder into a cavity formed in a die, having arranged therein at least one insert (20) including a gas permeable plate (21), which faces the interior of the powder box (2) and which is arranged at an angle $\alpha$>0° relative to the bottom (6) of the powder box (2), a gas impermeable backing (22) and a spacing (23) therebetween, the spacing (23) being connectable to a gas supply through at least one hose (3).

2. The powder box (2) according to claim 1 wherein the angle $\alpha$ varies between 30 and 90°.

3. The powder box (2) according to claim 1, having two inserts (20) positioned on opposing sides of the powder box (2).

4. The powder box (2) according to claim 1, wherein the inserts (20) are attached to the walls (8) on the inside of the powder box (2) by means of glue, welding or screws.

5. An insert (20) for a powder box (2) comprising a gas permeable plate (21), a gas impermeable backing (22) and a spacing (23) therebetween, the spacing (23) being connectable to a gas supply.

6. The insert (20) according to claim 5, wherein the insert (20) is adjustable within the powder box (2).

7. The insert (20) according to claim 5, wherein the largest pore of the gas permeable plate is smaller than the smallest particle of the powder used.

8. The insert (20) according to claim 5, wherein the gas permeable plate (21) is of a polymer, metal or a ceramic material or a mixture thereof.

9. A method for filling powder into a cavity (30) formed in a die (31) comprising the steps of:

a) supplying gas to a powder box (2), which is movable horizontally toward and away from a position just above the cavity (30), whereby the gas is supplied through a permeable plate (21) which is arranged on at least one insert (20), whereby the plate faces the interior of the powder box (2) and is arranged at an angle $\alpha$, which is >0° C., relative to the bottom (6) of the powder box (2) so that particles of the powder in the powder box (2) are movable relative to each other; and b) moving the powder box (2) to the position just above the cavity (30) so that the powder in the powder box (2) enters the cavity (30) at least by gravity.

10. The method according to claim 9, wherein the gas flow through the permeable plate (21) is set at a value that causes visual fluidisation of the powder.

11. The powder box (2) according to claim 2, having two inserts (20) positioned on opposing sides of the powder box (2).

12. The powder box (2) according to claim 2, wherein the inserts (20) are attached to the walls (8) on the inside of the powder box (2) by means of glue, welding or screws.

13. The powder box (2) according to claim 3, wherein the inserts (20) are attached to the walls (8) on the inside of the powder box (2) by means of glue, welding or screws.

14. The powder box (2) according to claim 11, wherein the inserts (20) are attached to the walls (8) on the inside of the powder box (2) by means of glue, welding or screws.

15. The insert (20) according to claim 6, wherein the largest pore of the gas permeable plate is smaller than the smallest particle of the powder used.

16. The insert (20) according to claim 6, wherein the gas permeable plate (21) is of a polymer, metal or a ceramic material or a mixture thereof.

17. The insert (20) according to claim 7, wherein the gas permeable plate (21) is of a polymer, metal or a ceramic material or a mixture thereof.

18. The insert (20) according to claim 15, wherein the gas permeable plate (21) is of a polymer, metal or a ceramic material or a mixture thereof.

* * * * *